United States Patent [19]

Moss et al.

[11] 4,345,351

[45] Aug. 24, 1982

[54] EXTENSION HANDLE FOR DUST MOPS AND THE LIKE

[75] Inventors: Theron C. Moss, Cleveland; Earl Boring, McDonald; Jerry Hjellum, Cleveland, all of Tenn.

[73] Assignee: SECO Industries, Inc., Cleveland, Tenn.

[21] Appl. No.: 239,501

[22] Filed: Mar. 2, 1981

[51] Int. Cl.[3] ..... B25G 1/04

[52] U.S. Cl. ..... 15/144 B; 16/115

[58] Field of Search ..... 15/143 B, 144 B, 410, 15/144 R; 16/115

[56] References Cited

U.S. PATENT DOCUMENTS

| | | | |
|---|---|---|---|
| 2,595,597 | 5/1952 | Morseth | 16/115 X |
| 2,984,852 | 5/1961 | George | 15/144 B |

FOREIGN PATENT DOCUMENTS

| | | | |
|---|---|---|---|
| 451455 | 8/1936 | United Kingdom | 15/144 B |
| 1002209 | 8/1965 | United Kingdom | 15/143 B |

*Primary Examiner*—Chris K. Moore

*Attorney, Agent, or Firm*—Maky, Renner, Otto & Boisselle

[57] ABSTRACT

Extension handle consists of a pair of telescoping handle parts made out of relatively thin-walled plastic tubing. A protrusion on the outer wall of the inner tubular member, formed as by inserting a pop rivet therethrough, frictionally engages the inner wall of the outer tubular member to provide some drag or resistance to axial movement of the tubular members relative to each other. The outer tubular member, being made of relatively thin-walled plastic tubing, will deform more or less according to the amount of interference between the rivet and inner wall of the outer tubular member. A rigid metal or plastic ring at the inner end of the outer tubular member acts as an abutment or stop for the protrusion on the inner tubular member thus preventing the telescoping handle parts from being completely pulled apart.

11 Claims, 4 Drawing Figures

EXTENSION HANDLE FOR DUST MOPS AND THE LIKE

BACKGROUND OF THE INVENTION

This invention relates generally as indicated to an extension handle, especially for use with relatively light weight domestic dust mops and the like, but which may also be used in other applications as well. The usual domestic dust mop has a relatively short handle to facilitate handling and use as well as storage. However, there are numerous occasions when it would also be desirable to have a substantially longer handle to reach higher places for dusting such things as shelves, light fixtures, corners between the ceiling and walls, etc.

An ideal handle to satisfy both the need for a shorter handle for close dusting and storage and a longer handle for reaching less accessible areas would be one that telescopes. However, a major drawback to most telescoping handles for this particular application is their relatively high cost and weight. For this and similar applications, there is a need for a relatively inexpensive, light weight extension handle which may be easily adjusted to different lengths by applying a simple axial force thereto, and which will remain in the desired adjusted position during use.

SUMMARY OF THE INVENTION

With the foregoing in mind, it is a principal object of this invention to provide an extension handle which is relatively inexpensive and light weight and can easily be adjusted to any desired length.

Another object is to provide such an extension handle including a pair of telescoping handle parts that can be longitudinally adjusted to any desired relative position by application of a simple axial force thereto.

Still another object is to provide such an extension handle which is relatively simple in construction and easily manufactured and assembled.

Yet another object is to provide such an extension handle in which the telescoping handle parts are precluded from being pulled completely apart.

These and other objects of the present invention may be achieved as by making the telescoping handle parts out of relatively thin-walled plastic tubing, with a protrusion on the outer wall of the inner tubular member, formed as by inserting a metal pop rivet through the wall thereof, which frictionally engages the inner wall of the outer tubular member to provide some drag or resistance to axial movement of such tubular members relative to each other. Because the telescoping members are made of relatively thin-walled plastic tubing, the amount of interference between the protrusion on the inner tubular member and the wall of the outer tubular member is not very critical, in that the outer tubular member will deform within limits according to the amount of interference therebetween. However, the amount of interference must nevertheless be controlled to some extent so that the telescoping handle parts can be readily longitudinally adjusted relative to each other while still providing sufficient frictional drag therebetween to retain the members in the desired adjusted position during use. A rigid metal or plastic ring at the inner end of the outer tubular member acts as an abutment or stop for the protrusion on the inner tubular member thus preventing the telescoping handle parts from being completely pulled apart.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
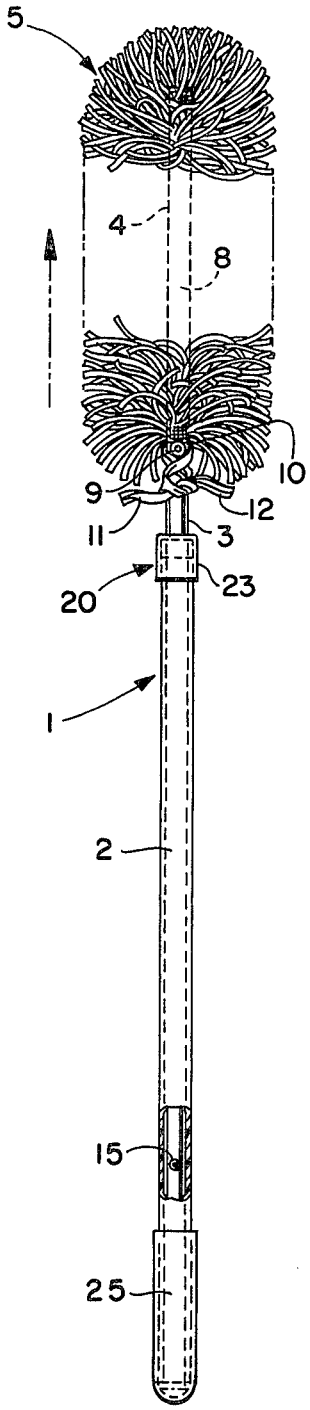
FIG. 1 is a side elevation view of a preferred form of extension handle in accordance with the present invention shown having a duster head attached thereto.
Figure 2:
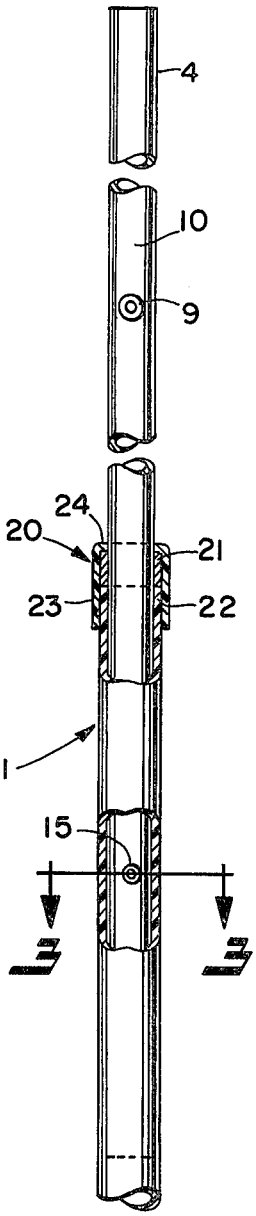
FIG. 2 is an enlarged fragmentary longitudinal section through the extension handle of FIG. 1 showing the telescoping handle parts partially extended.

In FIG. 1 there is shown a preferred form of extension handle 1 in accordance with the present invention including a pair of telescoping tubular handle parts 2 and 3 which may be axially displaced relative to each other in a manner to be subsequently described. Attached to the outer end 4 of the inner telescoping member 3 is a duster head 5 which may be of any suitable type such as for domestic use. The duster head 5 shown includes a central sleeve portion 8 adapted to be slipped over the outer end of the inner tubular member 3. A pop rivet 9 or the like may extend outwardly from the wall 10 of the inner tubular member adjacent the inner end of the duster head 5 to provide a convenient means for tying the duster head to the handle using suitable ties 11,12 as shown. Although such extension handle is particularly suited for use with duster heads of this general type, it will be appreciated that such extension handle may also be used in other applications as well.

The telescoping handle parts 2, 3 are preferably made from relatively thin-walled plastic extruded tubing, with the outer diameter of the inner tubular member being slightly less than the inner diameter of the outer tubular member to permit the tubular members to be telescopically received one within the other and axially displaced relative to each other.

Figure 3:
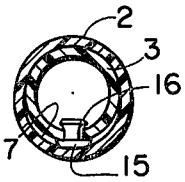
FIG. 3 is an enlarged transverse section through the telescoping handle parts of FIG. 2 taken on the plane of the line 3—3 thereof.
Figure 4:
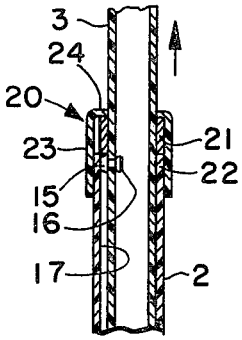
FIG. 4 is an enlarged fragmentary longitudinal section through the telescoping handle parts in the region where the inner tubular member extends outwardly from the outer tubular member, such telescoping handle parts being shown in the fully extended position where they are retained against further axial outward movement relative to each other.

To permit the telescoping handle parts to be readily longitudinally adjusted to any desired relative position and still be retained in the desired adjusted position during use, a protrusion 15 is provided on the outer wall of the inner tubular member 3 preferably formed by inserting a metal pop rivet 16 therethrough. As best seen in FIGS. 3 and 4, the rivet 16 frictionally engages the inner wall 17 of the outer telescoping member 2 to provide some drag or resistance to axial movement of the telescoping members relative to each other. By using relatively thin-walled plastic tubing for the telescoping members, the amount of interference between the rivet 16 on the inner tubular member and inner wall of the outer tubular member is not very critical, in that the outer tubular member will readily deform within limits more or less according to the amount of interference therebetween. Of course, the amount of interference must nevertheless be controlled within certain limits so that the telescoping tubular handle parts can be readily moved axially relative to each other while still providing sufficient frictional drag therebetween to retain the telescoping tubular handle parts in the desired adjusted position during use.

Although such dimensions may vary, in one form of extension handle in accordance with this invention, both the inner and outer telescoping members 2, 3 have a wall thickness of approximately 3/64". Also, the outer diameter of the inner tubular member 3 is approximately ⅜", and the rivet 16 protrudes approximately another 3/64" therefrom, whereas the inner diameter of the outer tubular member 2 is approximately 21/32".

Outward movement of the rivet 16 beyond the inner end of the outer tubular member may be precluded as by providing a stop 20 in the form of a rigid metal or plastic ring 21 at the outer end 22 of the outer tubular member. The ring 21 may be retained in place by means of a vinyl sleeve 23 having an inturned flange 24 at its outer end closely surrounding the outer wall of the inner tubular member and overlying the outer end of the ring. The sleeve 23 extends axially over the outer end 22 of the outer tubular member in close contact therewith and is secured thereto as by means of a suitable adhesive. The inner diameter of the ring 21 is slightly greater than the outer diameter of the inner tubular member 3 but less than the extent of protrusion of the rivet 16 therefrom, whereby when the inner tubular member is fully extended as shown in FIG. 4, the rivet 16 will engage the ring thereby precluding further outward movement of the inner tubular member relative to the outer tubular member.

While the location of the rivet 16 along the length of the inner tubular member may vary, it should be sufficiently spaced from the innermost end of the inner tubular member so that when the extension handle is fully extended, there is still sufficient overlap, for example, five to six inches, between the inner and outer tubular members to provide adequate support therebetween. Also, while the lengths of the tubular members may vary, in one form of extension handle in accordance with this invention, the outer tubular member 2 has a length of approximately twenty-two inches, and the inner tubular member has a length of approximately thirty-four inches. A plastic hand grip 25 or the like may be provided at the outer end of the outer tubular member which also acts as a closure for such end precluding axial inward movement of the inner tubular member beyond the outer end of the outer tubular member. With the tubular members dimensioned as indicated above, when the extension handle is fully retracted, the inner tubular member will still extend approximately twelve inches beyond the outer end of the outer tubular member, to provide sufficient length for supporting the duster head 5 thereon. Moreover, when the extension handle is fully extended, the inner tubular member will extend approximately twenty-eight inches beyond the outer tubular member, leaving an overlap of approximately six inches between such tubular members when fully extended.

From the foregoing, it will now be apparent that the extension handle of the present invention is of a relatively light weight and inexpensive construction which readily permits the telescoping handle parts to be longitudinally adjusted to any desired relative position by application of a simple axial force thereto while still providing sufficient frictional resistance to such movement to retain the handle parts in the desired adjusted position during use.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. An extension handle for dust mops and the like comprising an outer tubular member and an inner tubular member telescopically received in said outer tubular member, said inner and outer tubular members beiang axially movable relative to each other to vary the length of said extension handle, one of said tubular members having a protrusion thereon frictionally engaging the other tubular member to provide sufficient resistance to such relative axial movement to retain said extension handle in the desired adjusted position during use, and the other tubular member being made of relatively thin-walled plastic tubing to permit some deformation thereof according to the amount of interference between said protrusion and said other tubular member.

2. The extension handle of claim 1 wherein both of said tubular members are made of relatively thin-walled plastic tubing.

3. The extension handle of claim 2 wherein said protrusion is on the outer wall of said inner tubular member and frictionally engages the inner wall of said outer tubular member.

4. The extension handle of claim 3 wherein said protrusion comprises a metal rivet inserted through the wall of said inner tubular member and extending outwardly therefrom into frictional engagement with the inner wall of said outer tubular member.

5. The extension handle of claim 3 further comprising a rigid ring, and means for retaining said ring at the inner end of said outer tubular member, said ring acting as a stop for said protrusion preventing axial outward movement of said protrusion beyond the inner end of said outer tubular member.

6. The extension handle of claim 5 wherein said means for retaining said ring at the inner end of said outer tubular member comprises a plastic sleeve having an inturned flange at its outer end overlying the outer end of said ring, said sleeve extending axially inwardly beyond the outer end of said outer tubular member in close contact therewith and secured thereto.

7. The extension handle of claim 5 wherein said protrusion on said inner tubular member is axially spaced from the innermost end of said inner tubular member a sufficient distance that when said extension handle is fully extended, there is still sufficient overlap between said inner and outer tubular members to provide adequate support therebetween.

8. The extension handle of claim 1 further comprising a plastic hand grip secured to the outer end of said outer tubular member, said hand grip providing a closure for said outer end limiting the extent of axial inward movement of said inner tubular member relative to said outer tubular member.

9. The extension handle of claim 8 wherein the length of said inner tubular member is sufficiently greater than the length of said outer tubular member that when said inner tubular member is fully retracted within said outer tubular member, said inner tubular member extends beyond the outer end of said outer tubular member a sufficient distance to support a duster head and the like thereon outwardly of said outer tubular member.

10. The extension handle of claim 9 further comprising means on said inner tubular member for securing a duster head and the like thereto.

11. The extension handle of claim 10 wherein said last-mentioned means comprises a rivet extending outwardly from the outer wall of said inner tubular member for tying a duster head and the like thereto, said rivet being located on said inner tubular member outwardly of said outer tubular member when said extension handle is fully retracted.

* * * * *